United States Patent [19]

Yokoi et al.

[11] Patent Number: 4,929,104

[45] Date of Patent: May 29, 1990

[54] PRINTER SYSTEM FOR ENABLING USER TO SELECT VARIOUS FORMS-FEED MODES

[75] Inventors: Takeshi Yokoi, Kagamigahara; Shuhei Okamori, Nagoya, both of Japan

[73] Assignee: Brother Kogyo Kabushiki Kaisha, Nagoya, Japan

[21] Appl. No.: 300,712

[22] Filed: Jan. 19, 1989

Related U.S. Application Data

[63] Continuation of Ser. No. 946,303, Dec. 24, 1986, abandoned.

[30] Foreign Application Priority Data

Dec. 25, 1985 [JP] Japan ..... 60-294505
Jan. 22, 1986 [JP] Japan ..... 61-11680

[51] Int. Cl.[5] ..... B41J 11/50

[52] U.S. Cl. ..... 400/605; 400/608.3; 400/708; 355/313

[58] Field of Search ..... 400/605, 611, 607, 608.3, 400/624, 625; 355;708/313

[56] References Cited

U.S. PATENT DOCUMENTS

| | | | |
|---|---|---|---|
| 4,326,815 | 4/1982 | Kapp | 400/625 |
| 4,452,543 | 6/1984 | Adkisson et al. | 400/605 |
| 4,475,833 | 10/1984 | Sawicki | 400/605 |
| 4,619,388 | 10/1986 | Ono et al. | 400/605 |
| 4,655,626 | 4/1987 | Okazaki | 400/605 |
| 4,671,686 | 6/1987 | Howes et al. | 400/605 |
| 4,688,957 | 8/1987 | Prevignano | 400/605 |

FOREIGN PATENT DOCUMENTS

| | | | |
|---|---|---|---|
| 2231116 | 1/1974 | Fed. Rep. of Germany . | |
| 2855253 | 7/1980 | Fed. Rep. of Germany | 400/605 |
| 3442814 | 11/1984 | Fed. Rep. of Germany . | |
| 201008 | 6/1983 | German Democratic Rep. . | |
| 44379 | 3/1985 | Japan | 400/607 |
| 46279 | 3/1985 | Japan | 400/605 |
| 99675 | 6/1985 | Japan | 400/605 |

OTHER PUBLICATIONS

Patent Abstracts of Japan, unexamined applications, Field M, vol. 6, No. 105, p. 160 M 136, The Patent Office Japanese Government, 6/15/82.

*Primary Examiner*—Eugene H. Eickholt
*Attorney, Agent, or Firm*—Jordan B. Bierman

[57] ABSTRACT

In a printer enabling a user to select different forms-feed modes, a cut-forms automatic-feed unit (12) and a continuous-forms feed cassette (14) are detachably mounted on a printer main body (10) in its upper surface of a rear portion of the main body (10) and in its rear surface of the rear portion of the same (10), respectively, so that the user can selectively mount at least one of such feed units (12, 14). The printer has forms-feed modes corresponding to the mounted feed units (12, 14) and another forms-feed mode for manually feeding a cut-form to the printer. Each of the feed units (12, 14) can be manually mounted on the printer main body (10) as required. When a forms-feed mode set by the user is different from its preceding mode and a form according to the preceding mode remains in a form-driving unit (54, 102, 104, 106) in the printer main body (10), a sensor detects such remaining form. If the preceding mode is a continuous-forms feed mode, such remaining form backs in a direction opposite to its feeding direction. If the preceding mode is not the continuous-forms feed mode, such remaining form is transported in its feeding direction by a predetermined amount so as to be discharged from the printer main body (10), through selective operation of the forms-driving unit.

8 Claims, 6 Drawing Sheets

PRINTER SYSTEM FOR ENABLING USER TO SELECT VARIOUS FORMS-FEED MODES

This application is a continuation of application Ser. No. 946,303, filed Dec. 241,986, now abandoned.

BACKGROUND OF THE INVENTION

The present invention relates to a printer which interlockes with its host computer to output various data on-line or to be employed as a data-processing terminal equipment for printing out the data off-line according to its operation conducted by an operator.

Consequently, in printing operation of this type of the printer, it is preferable to employ and select printing media, i.e., continuous-forms such as journal paper and the like, and cut-forms such as letter-size or legal-size paper of predetermined width, in accordance with a user's need.

In this case, it is necessary to provide a forms-feed unit for enabling the user to employ various kinds of forms in the printer. However, it is difficult to handle at a time such various kinds of forms such as the continuous-forms together with the cut-forms in a single feed unit. Consequently, in the printer, it is necessary to mount at a time a plurality of the forms-feed units corresponding to the various kinds of forms on a printer main body of the printer, or it is necessary to enabling the printer main body to be selectively coupled with such plurality of the forms-feed units.

In the former case, generally, at least two kinds of the forms-feed units one of which is a continuous-forms feed unit and the other of which is a cut-forms feed unit are integrally incorporated in the printer main body.

However, there is a case that the user needs only one kind of the forms-feed unit, which leads to a disadvantage that the user must purchase a needless forms-feed unit incorporated in the printer together with his needing forms-feed unit. On the other hand, on the maker's side, there is a problem in that the maker can not provide a product or printer for satisfying the user's need.

However, in order to satisfy the user's need, if various kinds of the printers each of which is provided with a specialized forms-feed unit are manufactured and provided, specifications of such products considerably increases to decrease a merit of mass production, i.e., to lead to an increase of the cost of production which is disadvantageous.

In the latter case, i.e., in the printer in which various kinds of the forms-feed units are changeably mounted on the printer main body, for example, there has been proposed that a mutual mount is provided in the same portion of the printer main body, on which mutual mount the various kinds of the forms-feed units each of which has a unit-construction can be mounted as required. Such proposal is advantageous in that, since the printer main body is mutually employed, the cost for production is decreased while the user's need to employ one kind of the forms-feed unit in the printer is satisfied. However, in case that the user needs to employ the continuous-forms and the cut-forms selectively, it is necessary to change the forms-feed units according to the needed form or paper at each time when different form is employed in the printer. Such changing operation of the forms-feed units is cumbersome and leads to a problem that the printer is deteriorated in its operability and reliability due to the possibility of the user's mistake in mounting operation of the forms-feed units, which mistake leads to a failure in the forms-feed operation.

In general, in the printer, in order to insert a front end of the continuous-form into the printer, or in order to manually insert the cut-forms one by one into the printer, it is necessary to place the printer off-line, i.e., to shut the communication between the printer and its host computer so as to enable the user to drive a forms-driving unit through his operation of switches provided in an operator panel of the printer. In case that the cut-forms are employed in the printer, various forms-feed modes are required, for example such as an automatic-feed mode and a manual-feed mode in which the cut-forms are manually inserted into the printer one by one by the operator.

SUMMARY OF THE INVENTION

It is an object of the present invention to resolve the above problems inherent in the conventional printer by providing a printer which has a construction for satisfying the user in his different uses and is easy and sure in operation while capable of being selectively operated on-line and off-line, and further enables the maker thereof to construct a mutual printer main body in providing a low-cost printer having various specifications required by the user.

It is another object of the present invention to provide a method of selecting different forms-feed modes in a printer including a printer main body, a first forms-feed unit and a second forms-feed unit, which printer main body is provided with a print unit for performing a printing operation in a printing position and a forms-driving unit for feeding a form to the printing position of the print unit, which first forms-feed unit feeds a first form or paper to the forms-driving unit, which second forms-feed unit feeds a second form or paper to the forms-driving unit; comprising the steps of: selecting the forms-feed modes of the forms-driving unit according to the first and second forms by the use of a mode-selection switch; comparing the thus selected present mode of the forms-feed modes with its preceding mode to examine whether the present mode coincides with the preceding mode; examining whether the form remains in the forms-driving unit by the use of a sensor; issuing a forms-driving signal in case that the sensor detects the existence of the remaining form to issue a detection signal thereof and that the present mode coincides with the preceding mode, so that the forms-driving unit is driven by a predetermined amount so as to discharge the remaining form from the forms-driving unit.

In order to accomplish the above objects of the present invention, according to the present invention, a printer main body of the printer of the present invention is essentially provided with a first mounting portion for enabling a cut-forms feed unit to be detachably mounted on the printer main body and a second mounting portion for enabling a continuous-forms feed unit to be detachably mounted on the printer main body, which second mounting portion resides in a position different from that of the first mounting portion of the printer main body. In addition, on the printer main body is also provided a mode-selection switch for enabling an operator to select a necessary forms-feed mode.

In the printer having a construction in which the cut-forms feed unit and the continuous-forms feed unit are mounted on the first mounting portion and the second mounting portion of the printer main body respectively, in case that the forms-feed mode is changed, since the resultant selected present mode is not coincident with its preceding mode, there is a fear that the form or paper of the preceding mode remains in the forms-driving unit to interfere with a feeding operation of the form conducted according to the present mode. In this case, in consideration of such fear, the printer of the present invention is controlled as follows: if the form remaining in the forms-driving unit is a cut-form, such remaining cut-form is discharged from the forms-driving unit by driving the same in its forward direction by a predetermined amount; while if the form remaining in the forms-driving unit is a continuous-form, the forms-driving unit is driven in its reverse direction to discharge the continuous-form from the forms-driving unit so as to make it possible that the form of the present mode is inserted into the forms-driving unit of the printer.

The above controlling operation of the printer of the present invention is conducted by operating the mode-selection switch. Consequently, the sensor for detecting the existence of the form is provided in a position opposite to the forms-driving unit in the printer main body. The detection signal issued from the sensor is received by driving means for selectively driving the forms-driving unit in its feeding direction and reverse direction.

Further, in a preferable construction of the printer of the present invention, it is possible for the operator to select a cut-forms manual-feed mode by operating the mode-selection switch, in which cut-forms manual-feed mode the operator can insert the cut-forms into the printer main body manually one by one.

In another preferable construction of the printer of the present invention, the first mounting portion is provided in an upper surface of the rear portion of the printer main body, and the second mounting portion is provided in a rear surface of the rear portion of the pinter main body, so that the pair of the forms-feed units are prevented from interfere with each other in case that they are mounted on the printer main body at the same time.

Other features and advantages of the present invention will be apparent from the following description taken in connection with the accompanying drawings.

DESCRIPTION OF THE PREFERRED EMBODIMENT

Figure 1:
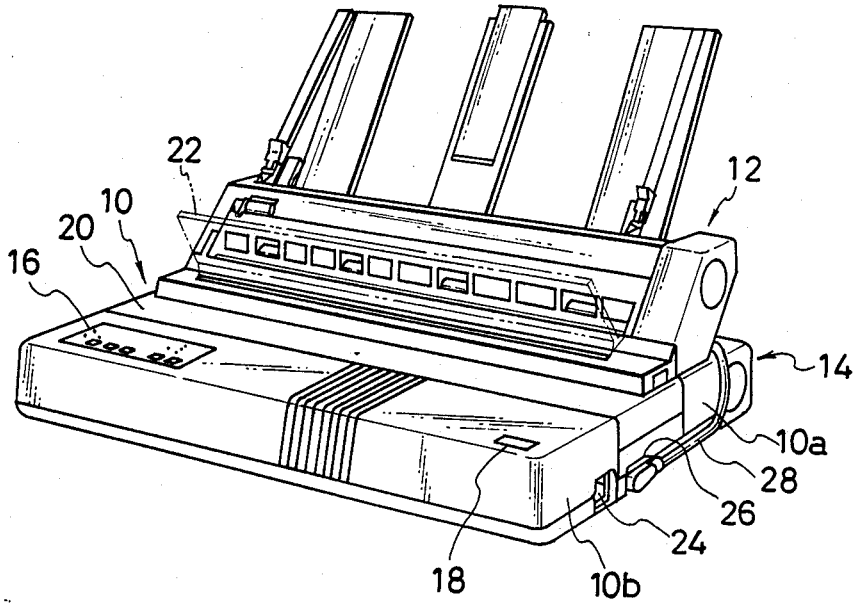
FIG. 1 is a perspective view of the embodiment of the printer of the present invention.

A printer of the present invention is shown in FIG. 1, wherein: a cut-forms automatic-feed unit 12 and a continuous-forms feed unit 14 are detachably mounted on a rear portion 10*a* of a printer main body 10 of the printer in its upper surface and in its rear surface, respectively. In an upper surface of a front portion 10*b* of the pinter main body 10 are disposed an operator panel 16 and a power-supply switch button 18, side by side. A printer cover 20 is mounted between the front portion 10*b* and the cut-forms automatic-feed unit 12 on the upper surface of the printer main body 10. As shown in FIG. 1 by means of chain lines, on the printer cover 20 are detachably mounted stacker 22 in which the cut-forms having been printed and discharged from the printer main body 10 are stacked into a neat pile.

In a side surface of the printer main body 10, there are provided a power-supply connection 24 and a service connection 26. A connection cord 28 extended from the cut-forms automatic-feed unit 12 is connected to the service connection 26 of the printer main body 10.

Figure 2:
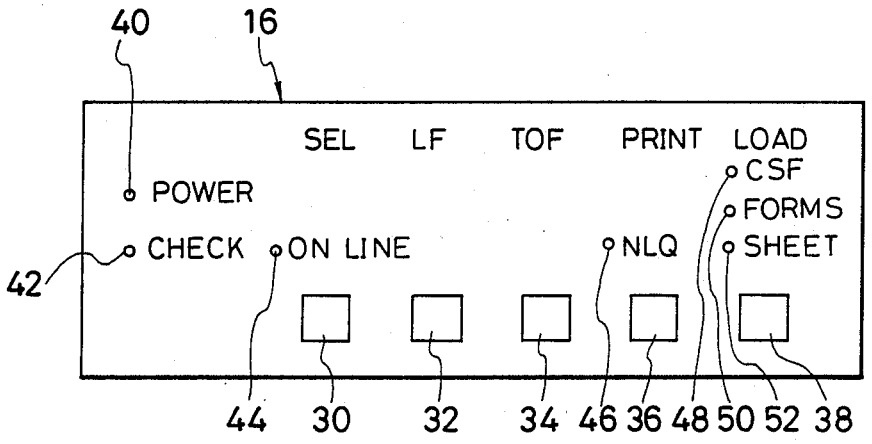
FIG. 2 is an enlarged view of the operator panel of the printer shown in FIG. 1.

In FIG. 2, on the operator panel 16 are disposed switches 30, 32, 34, 36, 38 and indicator lamps 40, 42, 44, 46, 48, 50, 52. The switch 30 is an on/off-line switch to connect/disconnect the printer with its host computer. The switch 32 is a line-feed switch which causes a forms-driving unit of the printer main body 10 to rotate in its feeding direction so long as the line-feed switch 32 is depressed in operation. The switch 34 is a forms-driving starting switch. The switch 36 and a lamp 46 are components employed in a printing operation conducted on-line, and, therefore, they do not relate to the gist of the present invention. Consequently, they are neglected in the following description. The switch 38 is a mode-selection switch for selecting the forms-feed modes. When the power-supply switch button 18 is depressed in the embodiment of the present invention, the cut-forms manual-feed mode is automatically established, and a lamp 52 is turned on to indicate such cut-forms manual-feed mode. When the mode-selection switch 38 is depressed one time, the forms-feed mode is changed from the cut-forms manual-feed mode to the continuous-forms feed mode and the lamp 50 is turned on. When the mode-selection switch 38 is depressed another one time, the cut-forms automatic-feed mode is selected and the lamp 48 is turned on. When the mode-selection switch 38 is depressed further another one time, the mode returns to its initial cut-forms manual-feed mode. In the above manner, such three modes may be sequentially selected in the above order at each time that the mode-selection switch 38 is depressed. Namely, the selection of the modes can be accomplished in a simple one-touch manner.

The lamp 40 is a power-supply indicator lamp. The lamp 42 is an extraordinary-condition indicator lamp which is turned on, for example, in case that the form to be fed expires. The lamp 44 is a selection indicator lamp which stays on so long as the printer of the present invention is placed on-line in operation with respect to its host computer.

Incidentally, all the above-mentioned lamps are constructed of light-emitting diodes.

Figure 3:
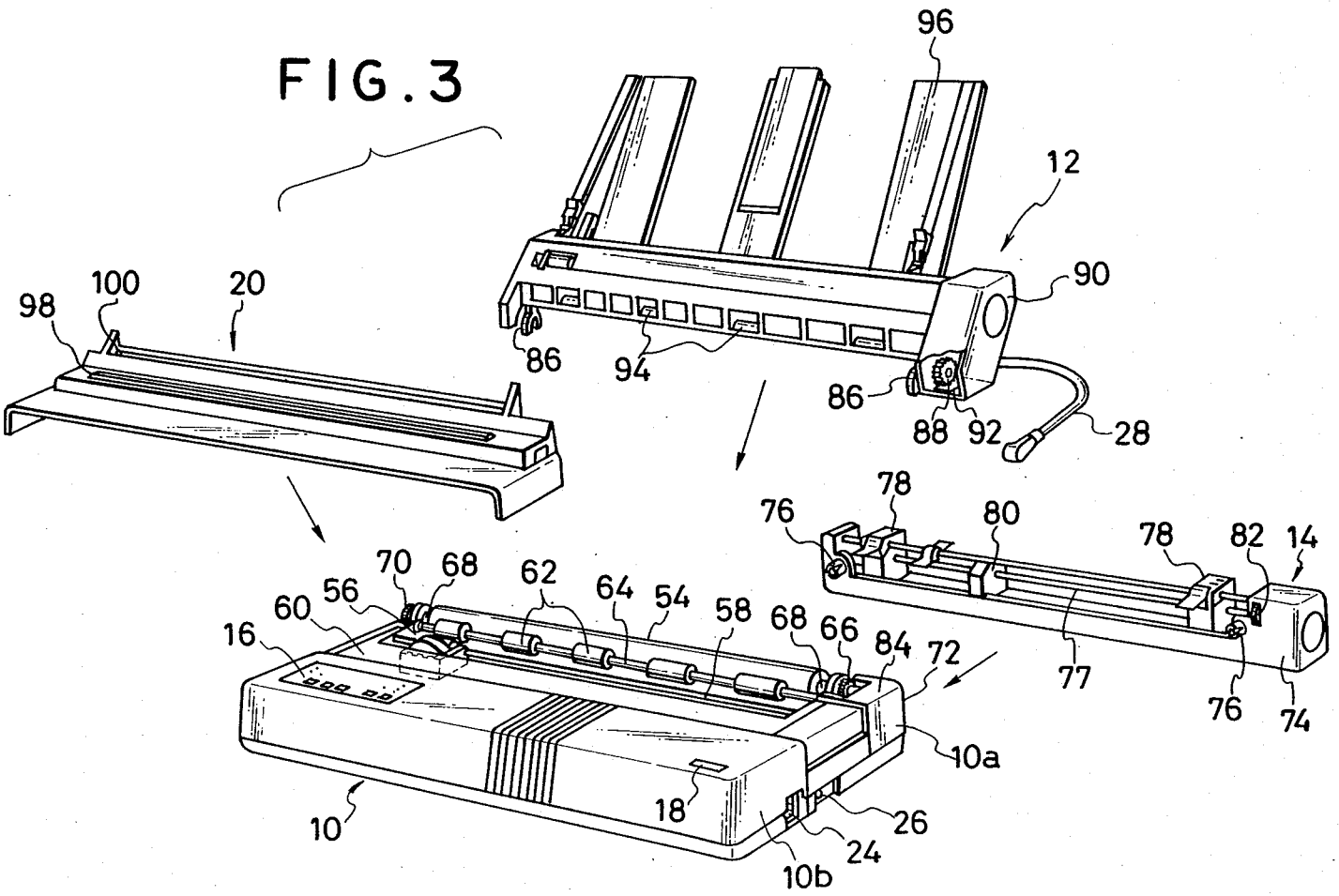
FIG. 3 is an exploded view of the printer shown in FIG. 1, in which are separated from the printer main body a cut-forms feed unit, continuous-forms feed unit and a printer cover, shown in a perspective manner.

As shown in FIG. 3, a cylindrical platen 54 is laterally disposed in the rear portion 10*a* of the printer main body 10. In a position opposite to the platen 54 is disposed a guide bar 58 on which is slidably mounted a stylus matrix-type print head 56. A ribbon-cassette 60 is disposed in the printer main body 10 so as to encircle the print head 56. A print unit of the printer of the present invention has the above construction. A paper bail 64 provided with a plurality of rollers 62 abuts on the the platen 54 through the rollers 62 as is in a construction of a conventional printer.

The platen 54 is supported by the printer main body 10 in its opposite ends rotatably. A transmission gear 66 is fixed to an end portion of the platen 54 so as to rotate integrally with the platen 54, which end portion is shown in FIG. 3 as a right-hand side end portion of the platen 54. In addition, in the vicinity of opposite end portions of the platen 54, there are provided a pair of journal portions 68 which are smaller in diameter than an intermediate portion of the platen 54. In the other end portion, i.e., left-hand side end portion of the platen 54 shown in FIG. 3 is provided a platen knob 70 which the operator can manually rotate.

A pair of engaging split pins 76 are provided in opposite ends of a front surface of a unit frame 74 of the continuous-forms feed unit 14 which is detachably mounted on a rear surface 72 of the rear portion 10*a* of the printer main body 10, which split pins 76 project from the front surface of the unit frame 74. The continuous-forms feed unit 14 is provided with a lateral axle 77 having a key way for preventing rotation. A pair of sprocket boxes 78 are slidably supported by the lateral axle 77 so as to slide along the axle 77. An interval between the pair of the sprocket boxes 78 is adjustable so as to be coincident in length with a width of the continuous-forms being employed in the printer. The reference numberal 80 denotes a guide block for the continuous-form, which block 80 may slide along the lateral axle 77 and is placed in a substantially intermediate position of the lateral axle 77 so that an intermediate portion of the continuous-form being fed is prevented from sagging downward. The reference numeral 82 denotes a transmission gear which partially extends from a front surface of the unit frame 74 and meshes with the forms-driving unit in the printer main body 10 when the continuous-forms feed unit 14 is mounted on the printer main body 10, as described later.

The cut-forms feed unit 12 is mounted on an upper surface 84 of the rear portion 10*a* of the printer main body 10 in its lower end portion so as to project rearward from the rear end of the printer main body 10 partially. The cut-forms feed unit 12 is provided with a pair of engaging hooks 86 in its opposite end portions in a projecting-downward manner, into which hooks 86 are received the journal portions 68 of the platen 54. The engaging hooks 86 are made of synthetic resins. Each of the engaging hooks 68 has a mouth a width of which is slightly smaller in length than a diameter of the journal portion 68 of the platen 54 to make it possible that the journal portions 68 of the platen 54 are press-fitted to the engaging hooks 86 of the cut-forms feed unit 12, whereby the unit 12 is detachably mounted on the printer main body 10 in a stable manner. Due to the resiliency of the engaging hooks 86 made of synthetic resins, it is possible to easily disengage the cut-forms feed unit 12 from the printer main body 10 by simply pulling up the feed unit 12.

The reference numeral 88 denotes a transmission gear which is received in the unit frame 90 and partially projects downward from a lower opening 92 of the unit frame 90, so that the gear 88 meshes with the transmission gear 66 of the platen 54 when the unit frame 90 is mounted on the printer main body 10, as described later. Such gear 88 is operatively connected to a forms-discharging roller 94 supported in the unit frame 90, as described later.

Predetermined-size cut-forms are stacked on a holder 96 into a neat pile and held therein.

Figure 4:
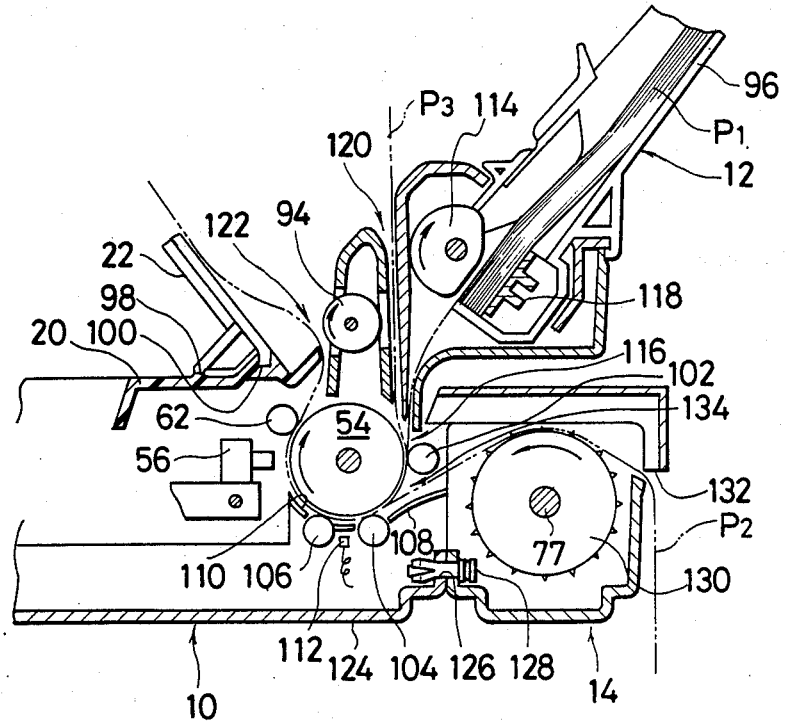
FIG. 4 is a longitudinal sectional view of the rear portion of the printer shown in FIG. 1, for illustrating the forms-transporting mechanism of the printer shown in FIG. 1.

A ridge 98 and a groove 100 parallel to the ridge 98 are formed in an upper surface of the printer cover 20. As shown in FIGS. 1 and 4, the stacker 22 is engaged with the ridge 98 and the groove 100 so as to be supported by the printer cover 20. In FIG. 3, the stacker 22 is neglected for clarifying illustrations of other components of the printer of the present invention.

As described in the above, the feed units 12, 14 and the printer cover 20 can be mounted on the printer main body 10 without any interference therebetween, as shown in FIG. 3 with arrows. According to the user's need, it is possible to mount one or both of the feed units 12, 14 on the printer main body 10 at a time when the product is shipped or sold, so as to cover various specifications of the product.

AS shown in FIG. 4, in a lower area and a rear area of the platen 54 in the printer main body 10, a plurality of feed rollers 102, 104, 106 are disposed to be brought into a press-contact with the platen 54. A paper guide member 108 is disposed in the printer main body 10 so as to define a forms-transporting path 110 in cooperating with a peripheral surface of the platen 54. These feed rollers 102, 104, 106 construct a forms-driving unit in cooperating with the platen 54, and follow the same 54 in rotating in a direction shown in FIG. 4 with by means of an arrow of the platen 54, so that the form clamped between the platen 54 and the feed rollers 102, 104, 106 is transported in its feeding direction toward the print head 56. When the platen 54 is rotated in its reverse direction, the feed rollers 102, 104, 106 are accordingly rotated to back the form in a direction opposite to its feeding direction.

A sensor 112 constructed of a photo-electric device is disposed in a position opposite to the forms-transporting path 110 so as to detect the existence of the form in such path 110 and issues a detection signal thereof in case that the existence of the form is detected.

In the cut-forms feed unit 12, there is provided a driving cam roller 114 which rotatably and sequentially drive the cut-forms $P_1$ having been stacked on the holder 96 thereof so as to transport the forms $P_1$ to the platen 54 one by one, so that the form $P_1$ is introduced into a first forms-feed opening 116 defined between the platen 54 and the feed roller 102 in the printer main body 10.

In the holder 96, the stacked cut-forms $P_1$ are always urged against the cam roller 114 resiliently by means of a back-up plate 118 which is energized by a spring.

In a front side of the cut-forms feed unit 12, the forms-discharging roller 94 is supported, while there is formed an insertion-guide path 120 for cut-forms $P_3$ being manually fed. The insertion-guide path 120 is communicated with the first forms-feed opening 116 in its lower end. The operator can fed the cut-forms $P_3$ to the printer main body 10 by manually inserting the cut-form $P_3$ into the insertion-guide path 120, according to a so-called manual-feed mode.

A forms-discharging opening is defined between the forms-discharging roller 94 and a rear end edge of the printer cover 20. As shown in FIG. 4, in a condition in which the stacker 22 is mounted on the printer cover 20, the cut-forms $P_1$, $P_3$ having been printed are stacked on the stacker 22.

Figure 5:
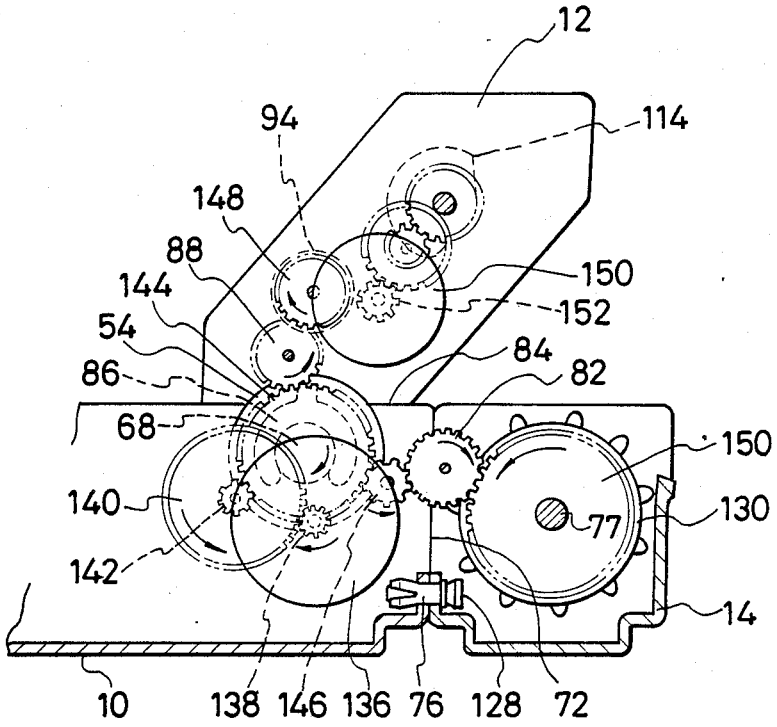
FIG. 5 is a longitudinal sectional view of the rear portion of the printer shown in FIG. 1, for illustrating the forms-driving mechanisms in the forms-driving unit of the printer main body, the cut-forms feed unit and the continuous-forms feed unit.

As shown in FIGS. 4 and 5, the continuous-forms feed unit 14 is fixedly mounted on the printer main body 10 by inserting the split pins 76 of the continuous-forms feed unit 14 into mounting holes 126 formed in a frame 124 of the printer main body 10, in which split pins 76 are forcibly inserted plungers 128 which enlarge the diameter of the split pins 76 so as to press-fit the slit pins 76 to the mounting holes 126 of the frame 124 of the printer main body 10. The continuous-forms feed unit 14 can be disengaged from the printer main body 10 by simply pulling the plungers 128 out of the split pins 76. The mounting holes 126 are provided in the vicinity of the opposite ends of the rear surface of the rear portion 10*a* of the printer main body 10, so as to correspond to the split pins 76 of the continuous-forms feed unit 14, so that the continuous-forms feed unit 14 is fixedly mounted on the printer main body 10 at two positions.

A sprocket wheel 130 supported by the lateral axle 77 is rotated in a forms-feeding direction shown in FIG. 5 by means of an arrow, so that the continuous-form $P_2$ introduced from an introducing opening 132 of the continuous-forms feed unit 14 is transported to a second forms-feed opening 134 which is defined between the platen 54 and the feed roller 104.

As shown in FIG. 5, a stepping motor 136 is disposed in the printer main body 10 and is provided with a motor shaft on which is fixedly mounted a gear 138 which meshes with a mid gear 140 which is integrally provided with a coaxial gear 142 meshing with a platen-driving gear 144. In a condition in which both the cut-forms feed unit 12 and the continuous-forms feed unit 14 are mounted on the printer main body 10, the transmission gear 88 of the cut-forms feed unit 12 directly meshes with the platen-driving gear 144, while the transmission gear 82 of the continuous-forms feed unit 14 meshes with the platen-driving gear 144 through a mid gear 146 of the printer main body 10.

The transmission gear 88 meshes with a gear 148 which is integrally rotated with the forms-discharging roller 94. On the other hand, the other transmission gear 82 meshes with a gear 150 which is integrally rotated with sprocket wheel 130.

Consequently, when the stepping motor 136 rotates clockwise or in its forward direction indicated by an arrow in FIG. 5, the platen 54 rotates in the forms-feeding direction together with the feed rollers 102, 104, 106 which form the forms-driving unit together with the platen 54, and the forms-discharging roller 94 is rotated in its forms-discharging direction while the sprocket wheel 130 is rotated in its forms-feeding direction. On the other hand, when the stepping motor 136 rotates in its reverse direction, each of the above interlocked rotations is inverted in direction. Power is supplied to the stepping motor 135 through the power-supply connection 24 shown in FIG. 1.

As shown in FIG. 5, another stepping motor 150 for feeding the cut-forms is provided in the cut-forms feed unit 12. A driving force generated in the stepping motor 150 is transmitted to a gear 156 through a gear 152 mounted on a motor shaft of the stepping motor 150, a mid gear 154 and another mid gear 155 which is coaxially fixed to the mid gear 154 and meshes with the gear 156 which is coaxially fixed to the cam roller 114.

Power is supplied to the stepping motor 150 from the service connection 26 provided in the printer main body 10, through the connection cord 28 as shown in FIG. 1.

Figure 6:
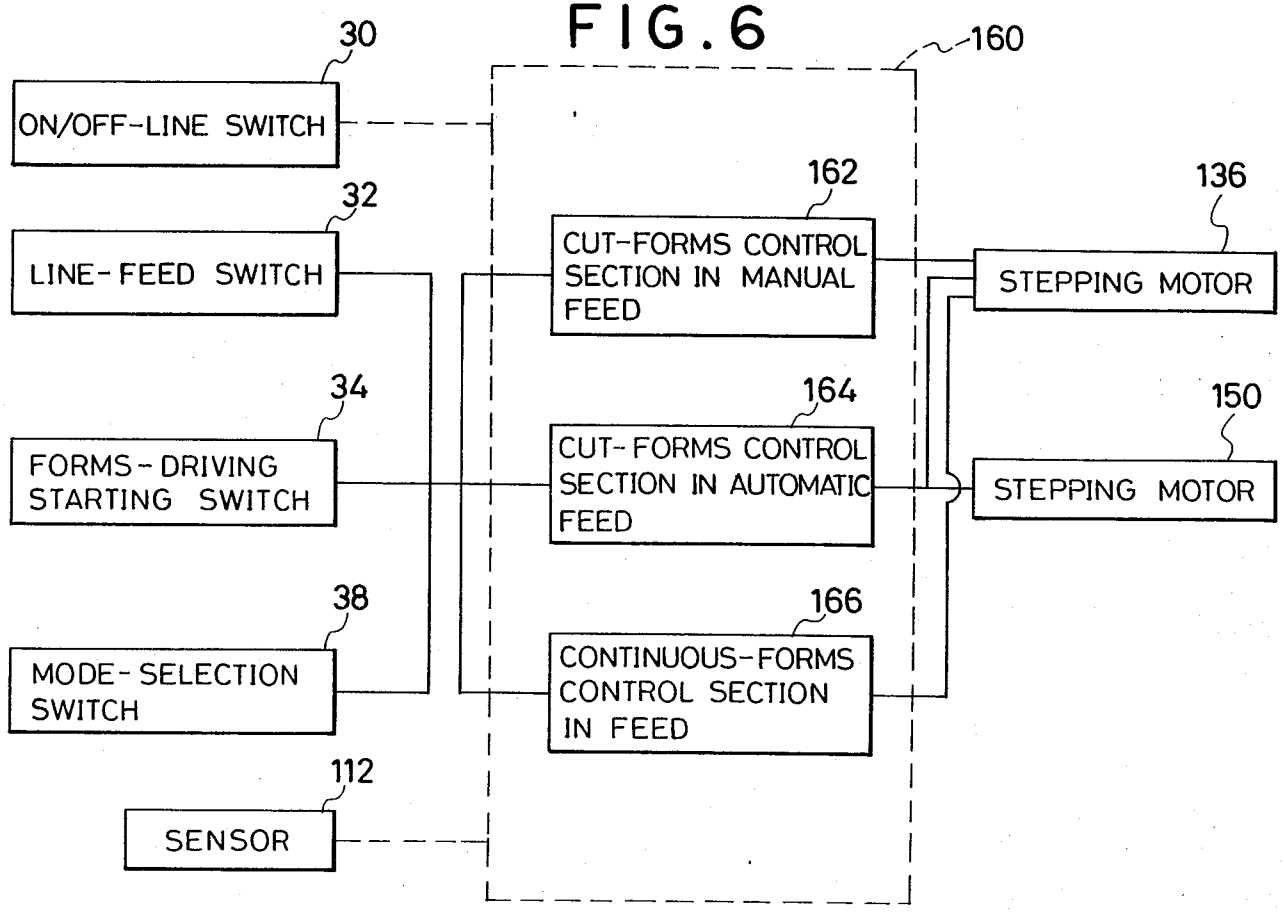
FIG. 6 is a block diagram of the control unit of the printer shown in FIG. 1.

With reference to FIG. 6, selection of the forms-feeding mode and a control apparatus 160 for conducting such selection will be described hereinbelow.

As shown in FIG. 6, the control apparatus 160 is provided with a cut-forms manual-feed control section 162, cut-forms automatic-feed control section 164 and a continuous-forms feed control section 166, and is constructed of a micro computer comprising CPU (central processors), ROM (read only memory) and RAM (random access memory), while electrically connected to the switches 30, 32, 34, 38, the sensor 112 and the pair of the stepping motors 136, 150.

In case that a cut-forms automatic-feed mode is selected by means of the mode-selection switch 38, the cut-forms automatic-feed control section 164 receives a forms-feeding signal to drive the stepping motor 150 which makes the cam roller 114 rotate one full turn, so that the cut-forms having been stacked on the holder 96 are transported to the first forms-feed opening 116 one by one. Then, the stepping motor 136 is driven to make the platen 54 rotate in its forms-feeding direction, so that the cut-form $P_1$ is transported to the forms-driving unit (54, 102, 104, 106). At this time, when the sensor 112 detects the existence of the form, the stepping motor 136 is rotated by a predetermined amount so that a leading end, i.e., a front end of the cut-form $P_1$ passes through the print head 56 and stops at a predetermined position. When the cut-form $P_1$ is positioned at its printing position, the cut-form $P_1$ is sequentially transported according to its normal printing operation.

When the mode-selection switch 38 is set to the continuous-forms feed mode, the continuous-forms feed control section 166 receives the forms-feeding signal to drive the stepping motor 136 so that the continuous-form $P_2$ having been mounted on the sprocket wheel 130 is transported to a predetermined printing position as is in the case of the cut-forms automatic-feed mode. When the forms-feeding signal is again inputted to the continuous-forms feed control section 166, the continuous-form $P_2$ is further transported by a distance corresponding to a length of one page of the continuous-form $P_2$, i.e., a length of an interval between lateral scored lines for separation use of the continuous-form $P_2$, and is stopped there.

In case that the mode-selection switch 38 is set to the cut-forms manual-feed mode and that the cut-form $P_3$ is previously inserted into the first feed-opening 116 through the insertion-guide path 120 by the operator, when the cut-forms manual-feed control section 162 receives the forms-feeding signal, such section 162 drives the stepping motor 136 so that the cut-form $P_3$ is transported to a predetermined printing position and stopped there as is in the case of the cut-forms automatic feed mode of the cut-form $P_1$, thereafter.

Incidentally, in case that the printer of the present invention is placed off-line in use, the forms-feeding signal is produced by depressing the forms-driving starting switch 34.

Figure 7:
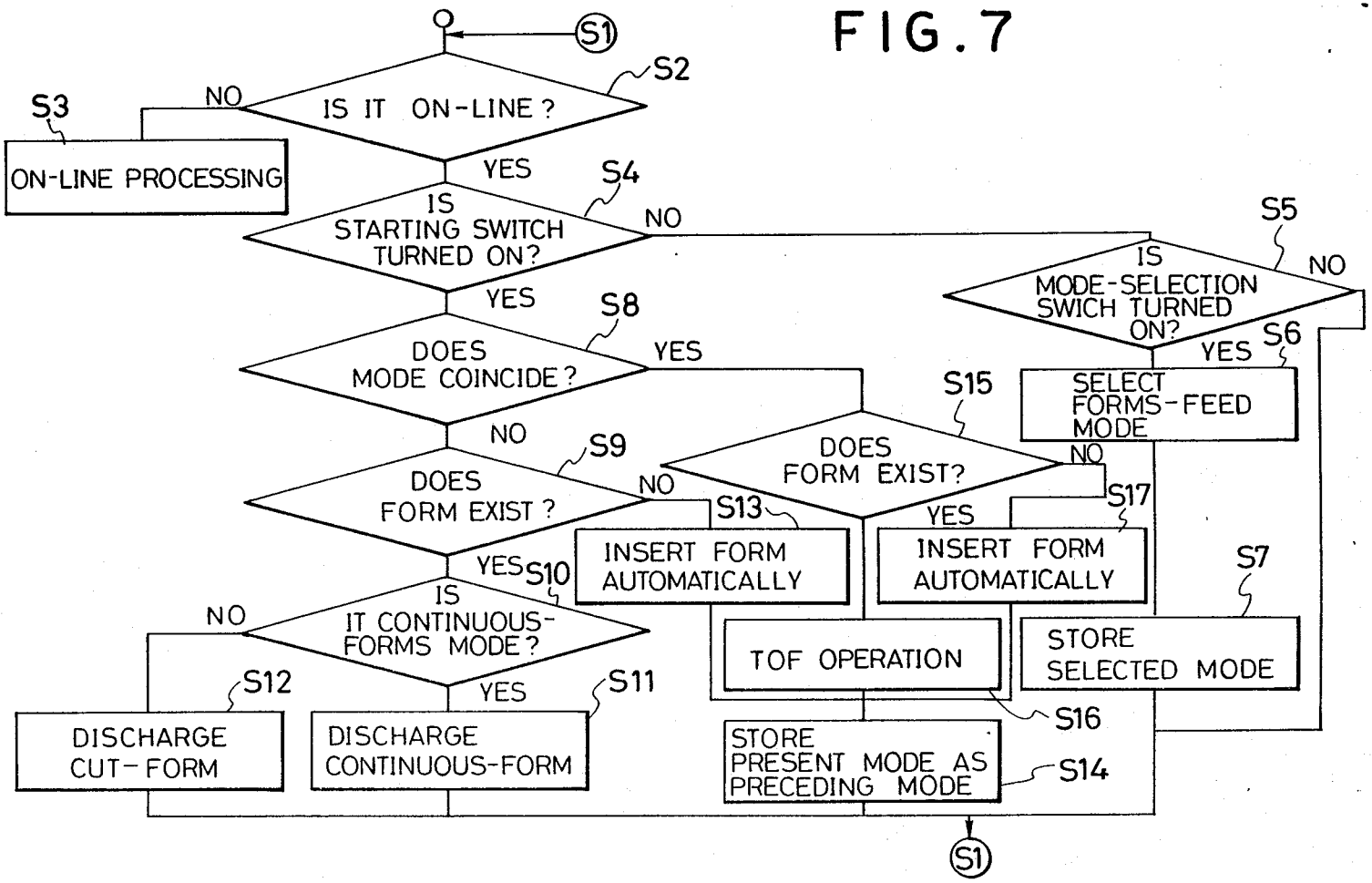
FIG. 7 is a flowchart of a program for performing the forms-feed mode selection in the printer shown in FIG. 1.

FIG. 7 is a flowchart for illustrating the off-line operation of the printer of the present invention. Incidentally, such operation of the printer is effectively conducted in case that the printer is provided with both the cut-forms feed unit 12 and the continuous-forms feed unit 14. However, the printer of the present invention is also effectively operated when provided with only one of the feed units 12, 14, without any disadvantage.

In case that the printer of the present invention is placed off-line in operation, after a starting step S1, there is provided a step S2 for examining whether an on-line switch 30 is depressed or not. When the on-line switch 30 has been depressed, the program shown in FIG. 7 is branched to a step S3 for conducting an on-line processing which is the same as that of the conventional printer and therefore neglected in the following description.

If the on-line switch 30 is not depressed, the program goes on to a step S4 for examining whether the forms-driving starting switch 34 is depressed or not. If the switch 34 is depressed, the program is branched to a step S5 for examining whether the mode-selection switch 38 is depressed or not. If the switch 38 is depressed, the program goes on to a step S6 in which a forms-feed unit having been selected is operated. Therefore, the program goes on to a step S7 for storing a mode-kind of the thus selected forms-feed mode. Under such circumstances, the program returns to the starting step S1 shown in FIG. 7. If the mode-selection switch 38 is not depressed, the program is branched to immediately return to the starting step S1. After such return to the step S1, it is again examined whether the forms-driving starting switch 34 is depressed or not. Until the forms-driving starting switch 34 is depressed, such routine is repeated. Consequently, as soon as the forms-driving starting switch 34 is depressed in the step S4, the program goes on to a step S8 for examining whether or not the present mode having been selected by the mode-selection switch 38 is coincident with the preceding mode selected previously. In the step S8, if the present mode is not coincident with the preceding mode, i.e., the changeover in mode is made, the program goes on to a step S9 for examining whether the sensor 112 detects the existence of the form. If the form exists, the program goes on to a step S10 for examining whether the preceding mode is a continuous-forms feed mode or not. If the preceding mode is the continuous-forms feed mode, the program goes on to a step 11 in which the forms-driving unit (54, 102, 104, 106) is rotated in its reverse direction by a predetermined amount, so that the continuous-form $P_2$ backs to be discharged from the printer main body 10 to the continuous-forms feed unit 14.

The reason why the forms-driving unit (54, 102, 104, 106) is rotated in its reverse direction in case of discharging the continuous-form $P_2$ resides in that: since the continuous-form $P_2$ is cut in its lateral scored lines positioned immediately after the forms-discharging opening 122 of the printer main body 10, the reverse rotation of the forms-driving unit (54, 102, 104, 106) makes it possible to discharge the continuous-form $P_2$ from the printer main body 10 in a shorter time than that required in the forward rotation of the forms-driving unit (54, 102, 104, 106). Such reverse rotation of the forms-driving unit (54, 102, 104, 106) is realized by rotating the stepping motor 136 shown in FIG. 5 in its reverse direction by a predetermined amount.

If the preceding mode is not the continuous-forms feed mode, the program shown in FIG. 7 is branched to a step S12 for rotating the forms-driving unit (54, 102, 104, 106) in its forward direction by a predetermined amount so that the cut-form remaining in the forms-driving unit (54, 102, 104, 106) is discharged from the printer main body 10 through the forms-discharging opening 122. In both the above cases, the discharging of the form is accomplished by rotating the stepping motor 136 by a predetermined amount at a time when the sensor 112 detects no existence of the form, so that the forms-driving unit (54, 102, 104, 106) is rotated by a minimum amount necessary for discharging the form from the printer main body 10 while not affected by variations in form-size or paper-size, printing position and the like.

Under such circumstances, the program returns to the starting step S1 in the flowchart shown in FIG. 7. After that, when the forms-driving starting switch 34 is depressed again, the program goes on to the step S9 for examining whether the form exists or not, and, as a result, the program is naturally branched to the step S13 since there is no form. Consequently, in the step S13, at least one of the stepping motor 136, 150 is rotated according to the selected forms-feed mode to automatically introduce a new form or paper into the printer main body 10, whereby such new form is set on the platen 54.

Under such circumstances, the program goes on to a step S14 for storing the present mode as a new preceding mode, i.e., for replacing the previous preceding mode with the present mode in the step S14. Such stored data is referred in examining whether the preceding mode is the continuous-forms feed mode or not.

Now, in case that the forms-driving starting switch 34 is depressed and that the mode-selection switch 38 has not been depressed or that the preceding mode is not selected even when the switch 34 has been depressed, the present mode is coincident with the preceding mode. In this case, if the sensor 112 detects the existence of the form in a step S15, a TOF operation is conducted in a step S16. Namely, in case that the cut-forms manual-feed mode or the cut-forms automatic-feed mode is selected, the form already existing in the printer main body 10 is discharged from the same 10 by rotating the forms-driving unit (54, 102, 104, 106) in its forward direction by a predetermined amount as is in the step S12 for discharging the cut-forms. On the other hand, in case that the continuous-forms feed mode is selected, the forms-driving unit (54, 102, 104, 106) is rotated in its forward direction by an amount corresponding to a length of one page of the continuous-form so as to transport the continuous-form by its one page.

In case that the sensor 112 does not detect the existence of the form in the step S15, a new form or paper is set on the platen 54 according to the selected mode in the step S17 as is in the step S13 of automatically inserting the form.

Incidentally, in each of the modes, when the sensor 112 does not detect the form even when the forms-driving unit (54, 102, 104, 106) is rotated by at least a predetermined amount in case that the form is fed and transported; or when the sensor 112 detects the existence of the form even when the forms-driving unit (54, 102, 104, 106) is rotated by at least a predetermined amount in case that the form is discharged form the printer main body 10, an alarm indicator lamp 42 is turned on to indicate that an extraordinary condition occurs.

In the printer of the present invention, the cut-forms manual-feed mode is automatically selected at a time when the power-supply switch button 18 is turned on. However, in case that, immediately after the power-supply switch button is turned on, other mode is selected by means of the mode-selection switch 38 and the forms-driving starting switch 34 is depressed, the printer of the pesent invention is immediately operated according to the thus selected other mode. Namely, after the power-supply switch button 18 is turned on, in only a first time cycle of the operation of the printer of the present invention, the program shown in FIG. 7 does not go on to the step S9 in the step S8 even when the changeover of the mode is conducted. In case of the following changeover of the mode is conducted, the program is executed as shown in the flowchart shown in FIG. 7.

In the embodiment of the present invention, as shown in FIG. 5, the forms-driving unit (54, 102, 104, 106) is interlocked with the continuous-forms feed unit 14 and driven by the stepping motor 136 which is a mutual driving source thereof. Consequently, in case that the forms-driving unit (54, 102, 104, 106) is rotated in its reverse direction to discharge the continuous-form $P_2$ from the printer main body 10, the continuous-form $P_2$ can be discharged from the printer main body 10 also through the sprocket wheel 130. In this case, naturally, it is also possible to drive the platen 54 and the sprocket wheel 130 by means of another driving source, or to rotate only the platen 54 by providing a clutch mechanism therebetween. In the thus designed printer of the present invention, in case that the continuous-form $P_2$ is transported in its reverse direction so as to be discharged from the printer main body 10, the continuous-form $P_2$ backs to a position in which the continuous-form $P_2$ is still engaged with the sprocket wheel 130 while disengaged from the platen 54, so that the continuous-form $P_2$ is held stationarily in such position while only the platen 54 is allowed to freely rotate so as to make it possible that the cut-form $P_1$ or $P_3$ is transported to the platen 54 under such circumstances. And, in case that the printer of the present invention is so designed that the sprocket wheel 130 is interlocked with the platen 54 in operation when the continuous-forms feed mode is selected, it is possible that the continuous-form $P_2$ is automatically set again, whereby the changeover operation in the entire modes can be conducted in an one-touch manner.

In the printer of the present invention, each of the printer main body 10, continuous-forms feed unit 14 and the cut-forms feed unit 12 has a detachable unit-construction to make it possible that they are combined with each other as required in use. Consequently, the printer of the present invention allows the user to select and purchase a necessary forms-feed unit 12 or 14, whereby the user can save his money. In addition, the printer of the present invention also allows the user to employ a plurality of the forms-feed units 12 and 14 at the same time. In such case, switching operations of both the mode-selection switch 38 and the forms-driving starting switch 34 allow the user to conduct the changeover operation of the forms-feed units 12 and 14 in an one-touch manner and also allow the user to select the manual-feed mode. If the form or paper is already set in the printer main body 10, such form is automatically discharged from the printer main body 10 as required according to the predetermined program shown in FIG. 7, so that there is no fear that the different kinds of the forms interfere with each other in the printer main body 10, to make the changeover operations of the forms-feed units 12, 14 simple and sure. Consequently, in the printer of the present invention, it is easy to employ the continuous-form $P_2$ and the cut-forms $P_1$, $P_3$ in its printing operation, and also easy to manually feed the different kinds of the cut-forms $P_1$, $P_3$ one by one sequentially. Therefore, the printer of the present invention is excellent in easiness in use to enable the user to smartly execute his business.

What is claimed is:

1. A method of selecting different form-feed modes in a printer including a printer main body, a cut form feed unit and a continuous form feed unit, for feeding cut forms and continuous forms, respectively, said printer means main body having a print unit for conducting a printing operation in a printing position and form-driving unit for transporting a form to said printing position, said method comprising;

selecting said form-feed modes according to the presence of said cut form or said continuous form by a mode-selection switch;

comparing a selected present mode with its preceding mode to determine whether said present mode is the same as or different from said preceding mode;

examining by means of a sensor whether one of said form is in said form-driving unit, and emitting a detection signal when the sensor detects the presence of one of said forms in the form-driving unit;

issuing a form-feed starting signal to drive the form-driving unit in a forward or reverse direction;

driving the form in the forward or reverse direction based on the detection of the presence or absence of the form by said sensor, mode-selection by said mode-selection switch, and determination that the present mode is or is not the same as the preceding mode;

driving said form-driving unit in the forward direction when said sensor emits a detection signal indicating that said preceding mode is the cut form feed mode, whereby said form-driving unit is driven to discharge said remaining cut form from said form-driving unit; and driving said form-driving unit in the reverse direction when said sensor emits a detecting signal indicating that said preceding mode is the continuous form feed mode and that said preceding mode is different from said present mode, whereby said form-driving unit is driven to discharge said remaining continuous form from the form-driving unit.

2. The method of claim 1 further comprising;

driving said form-driving unit in the forward direction by a predetermined amount when said sensor detects the presence of the form in said form-driving unit, said preceding mode is the continuous form mode, and the present mode selected by said mode selection switch is the same as the preceding mode.

3. The method of claim 1 further comprising:

driving said form-driving unit in the forward direction to bring a new form into the form-driving unit when said sensor detects the absence of the form remaining in the form-driving unit.

4. The method of claim 1 further comprising:

determining whether the preceding mod is the continuous-form feed mode.

5. A printer which enables a user to select various form-feed modes comprising:

a printer main body having a print unit capable of conducting a printing operation in a printing position;

a form-driving unit adapted to transport forms to said printing position, said form-driving unit mounted in said printer main body and connected to a first form-feed unit for feeding a cut form to said form-driving unit and a second form-feed unit for feeding a continuous form to said form-driving unit;

a mode-selection switch for selecting one of said form-feed modes based upon which mode said form-driving unit is in prior to operation of said mode-selection switch;

a sensor for detection of the presence of said cut form or said continuous form in said form-driving unit and for emitting a signal indicative thereof, said sensor being disposed in a position facing said form-driving unit;

examining means for examining whether a present form-feed mode coincides with a preceding form-feed mode;

driving means for selectively driving said form-driving unit in accordance with one of said form-feed modes in a forward or reverse direction;

said driving means including a single form-driving starting switch providing a form-driving starting signal, said driving means further including a determining means for determining whether the form should be fed in said forward direction or said reverse direction based on detection of the presence or absence of the form by said sensor, mode-selection by said mode selection switch, and determination, by said examining means, that the present mode is or is not the same as the preceding mode, said driving means adapted to drive said form-driving unit in the forward direction when said preceding mode is said cut form mode and said sensor detects the presence of said cut form or said continuous form in said form-driving unit and said driving means adapted to drive said form-driving unit in the reverse direction when said preceding mode is the continuous form mode, and said sensor detects the presence of said continuous form in said form-driving unit, and said present mode is different from the preceding mode as determined by said starting signal.

6. The printer of claim 5 wherein said driving means drives said form-driving unit in the forward direction by a predetermined amount when said sensor detects the presence of the form in said form-driving unit, said preceding form feed mode is the continuous mode, and the present mode selected by said mode-selection switch is the same as the preceding mode.

7. The printer of claim 5, wherein said driving means drives said form-driving unit in the forward direction to bring a new form into the form-driving unit when said sensor detects the absence of any form remaining in the form-driving unit.

8. The printer of claim 5, wherein said first unit comprises an automatic feeder which feeds stacked cut form one by one, said first unit further including manual feed means.

* * * * *